US010488130B2

(12) United States Patent
Kingsbury et al.

(10) Patent No.: US 10,488,130 B2
(45) Date of Patent: Nov. 26, 2019

(54) POST BARREL PLENUM OPERATED GAS CYCLING SYSTEM FOR AUTOMATIC FIREARMS

(71) Applicants: Klint McLean Kingsbury, Austin, TX (US); Clayton Warren Reinarz, New Braunfels, TX (US); Ronald Christopher Snider, New Braunfels, TX (US)

(72) Inventors: Klint McLean Kingsbury, Austin, TX (US); Clayton Warren Reinarz, New Braunfels, TX (US); Ronald Christopher Snider, New Braunfels, TX (US)

(73) Assignee: Rhino Precision, LLC, Dripping Springs, TX (US)

( * ) Notice: Subject to any disclaimer, the term of this patent is extended or adjusted under 35 U.S.C. 154(b) by 0 days.

(21) Appl. No.: 16/149,040

(22) Filed: Oct. 1, 2018

(65) Prior Publication Data

US 2019/0170460 A1 Jun. 6, 2019

Related U.S. Application Data

(62) Division of application No. 14/681,031, filed on Apr. 7, 2015, now abandoned.

(60) Provisional application No. 61/975,987, filed on Apr. 7, 2014.

(51) Int. Cl.
*F41A 5/26* (2006.01)
*F41A 5/28* (2006.01)

(52) U.S. Cl.
CPC .. *F41A 5/26* (2013.01); *F41A 5/28* (2013.01)

(58) Field of Classification Search
CPC ..... F41A 3/54; F41A 3/62; F41A 5/00; F41A 5/18; F41A 5/20; F41A 5/24; F41A 5/26; F41A 5/28; F41A 5/30
USPC ..... 89/191.01, 191.02, 193, 194
See application file for complete search history.

(56) References Cited

U.S. PATENT DOCUMENTS 1,877,118 A * 9/1932 Barnes ..... F41A 25/02 126/41 R
1,901,138 A * 3/1933 Barnes ..... F41A 21/30 89/14.3
2,150,161 A * 3/1939 Green ..... F41A 21/34 89/14.3

(Continued)

*Primary Examiner* — Jonathan C Weber
(74) *Attorney, Agent, or Firm* — Wood Herron & Evans LLP

(57) ABSTRACT

A gas buffer plenum positioned at the end of the barrel of an automatic firearm. A barrel side end cap connects the system to the barrel. A plenum tube holds one or more chamber walls and retains gas pressure within the enclosure. A target side end cap creates the final pressure chamber enclosure and is attached to the plenum tube to lock the system together. This gas buffer plenum allows a bullet to leave the barrel of the firearm before the bolt of the firearm starts to open. As the gas buffer plenum is filled with the exploding gas behind the bullet, the gas chambers build and maintain pressure that is then forced back through a hole in the plenum. The gas is forced down a gas tube or into a piston system. Depending on the configuration of the firearm, either the gas force, or the piston, strikes the bolt and cycles the firearm. The system may also be used to retrofit a gas operated firearm that uses a traditional gas block design.

5 Claims, 9 Drawing Sheets

(56) References Cited

U.S. PATENT DOCUMENTS 2,356,728 A * 8/1944 Reising ..... F41A 21/34 89/14.2
2,951,424 A * 9/1960 Stoner ..... F41A 3/16 89/179
3,776,093 A * 12/1973 Leverance ..... F41A 21/30 89/14.4
4,454,798 A * 6/1984 Shea ..... F41A 21/30 181/223
4,576,083 A * 3/1986 Seberger, Jr. ..... F01N 1/08 181/223
4,813,333 A * 3/1989 Garris ..... F41A 21/38 89/14.3
4,907,488 A * 3/1990 Seberger ..... F41A 21/30 181/223
5,679,916 A * 10/1997 Weichert ..... F41A 21/30 181/223
5,831,202 A * 11/1998 Rustick ..... F41A 21/26 89/193
6,308,609 B1 * 10/2001 Davies ..... F41A 21/30 181/223
6,374,718 B1 * 4/2002 Rescigno ..... F41A 21/30 89/14.4
7,237,467 B1 * 7/2007 Melton ..... F41A 21/30 89/14.4
7,856,917 B2 * 12/2010 Noveske ..... F41A 5/28 89/193
7,891,284 B1 * 2/2011 Barrett ..... F41A 5/28 89/14.4
7,946,214 B2 * 5/2011 Stone ..... F41A 5/18 89/193
8,104,570 B2 * 1/2012 Miller ..... F41A 21/30 181/223
8,528,458 B2 * 9/2013 Windauer ..... F41A 5/28 89/193
9,103,618 B2 * 8/2015 Daniel ..... F41A 21/325
2005/0115398 A1 * 6/2005 Olson ..... F41A 21/00 89/193
2007/0107590 A1 * 5/2007 Silvers ..... F41A 21/30 89/14.4
2012/0167756 A1 * 7/2012 Larue ..... F41A 5/28 89/193
2012/0167757 A1 * 7/2012 Gomez ..... F41G 1/02 89/193
2013/0291713 A1 * 11/2013 Zheng ..... F41A 5/20 89/191.02
2014/0190345 A1 * 7/2014 Daniel ..... F41A 21/325 89/193
2015/0184960 A1 * 7/2015 Monveldt ..... F41A 5/26 89/193
2015/0260472 A1 * 9/2015 Smith ..... F41A 21/30 89/14.2

* cited by examiner

POST BARREL PLENUM OPERATED GAS CYCLING SYSTEM FOR AUTOMATIC FIREARMS

CROSS REFERENCES TO RELATED APPLICATIONS

This Application claims the benefit under Title 35 United States Code § 120, as a Continuation (Divisional) of co-pending U.S. patent application Ser. No. 14/681,031, filed Apr. 7, 2015, which claims the benefit under Title 35 United States Code § 119(e) of U.S. Provisional Application 61/975,987, filed Apr. 7, 2014, the full disclosures of which are incorporated herein by reference.

BACKGROUND OF THE INVENTION

1. Field of the Invention

The present invention relates generally to firearms and more specifically to automatic gas operated firearms. The present invention provides a gas buffer plenum at the end of a firearm barrel that stores and directs high pressure gas through a gas tube to the receiver of the firearm in order to cycle the bolt after the bullet has left contact with the barrel rifling.

2. Description of the Related Art

Most currently available automatic gas operated firearms have a barrel with a small hole drilled vertically into the barrel to allow gas to escape up into a gas block. This vertical hole and gas block are typically located midway down the barrel. As a round is fired, the explosion forces the bullet down the barrel and past this small hole. As the bullet passes the hole, the still burning gun powder and gas are forced up through the small hole and into the gas block which directs the burning powder and gas in the opposite direction down a gas tube and back into the receiver of the firearm. Inside the receiver, the burning powder and gas impact the bolt and force it backwards to eject the spent round casing and load the next round. The balance of the burning powder and gas continue their reaction and expand down the remainder of the barrel, forcing the bullet out of the end and on down range.

Four issues result from the above described process. First, the small vertical port hole creates an inconsistency in the bullet path that can add vibration to the bullet. Vibration degrades accuracy. Second, the gas pulled from the barrel to cycle the bolt generates reduced and inconsistent gas pressure on the bullet as the bolt opens while the bullet is still in contact with the barrel rifling. This reduces velocity and also degrades accuracy. Third, due to the midpoint position of the vertical port hole, the powder from the round is not completely burned up inside the barrel. As such, unburnt powder enters into the gas tube and thereafter into the receiver and into the bolt mechanism. This unburnt powder can cause the bolt mechanism to foul faster and require more frequent cleaning for proper function. Fourth, the gas forces on the bolt vary greatly depending on port hole size, port hole position, and the length of the barrel. Therefore, for a given round and the same gas block, a short barrel might not correctly cycle the round while a longer barrel would, or the reverse could be true. This last issue creates the need for adjustable gas blocks that must be tuned precisely for each type of round.

SUMMARY OF THE INVENTION

The present invention does not require a vertical port hole in the barrel. This eliminates the inconsistency in the barrel and reduces bullet vibration, thus adding accuracy. The gas port hole is instead located in the buffer plenum of the present invention, past the end of the barrel rifling. The bullet leaves the rifling before the gas enters the plenum and is thereafter directed down the gas tube. The bullet is no longer in contact with rifling when the gas is drawn away and directed to the receiver and bolt. The bolt starts to open after the bullet is out of rifling contact. This allows for consistent gas pressure on the bullet throughout barrel travel on every shot. Consistent gas pressure generates increased and consistent velocity and thus adds accuracy. Because the gas port hole is located in the buffer plenum of the present invention, past the end of the rifling, the system allows for more of the powder to be burned before it is directed to the bolt. This reduces fouling and allows for longer operation between cleanings.

The buffer plenum of the present invention has multiple chambers. This causes the plenum to act like a capacitor as the bullet travels through. The multiple chambers store pressure that is consistently applied into the gas tube and to the bolt as the bullet passes through the chambers. This greatly reduces cycling issues with different rounds and barrel lengths. The end of barrel gas buffer plenum of the present invention is an improvement on the typical gas cycling mechanism for automatic firearms. Current gas operated repeating firearms do not offer the same accuracy and velocity as do bolt action firearms. The present invention allows the same or similar accuracy and velocity from a gas operated repeating firearm as that of a bolt action firearm. The system of the present invention further helps reduce the amount of fouling of the bolt as occurs in other gas operated firearms.

The structure of the preferred embodiment of the device of the present invention broadly comprises the following: a barrel side end cap; a target side end cap; a plenum tube or cylinder; at least one chamber wall; and a gas tube hole connected to a return gas tube. The barrel side end cap is designed to be affixed to the end of a rifled gun barrel. The device may be affixed to the barrel by any method, not limited to the following: threaded, welded, bolted, snap-on, quick attach, clamp etc. The barrel side end cap may be fabricated from, but not limited to, steel, stainless steel, titanium, aluminum, polymer, ceramic, Inconel, etc. The barrel side end cap also allows for the bullet to pass through without contact and thereafter enter into the buffer plenum enclosure. The barrel side end cap preferably has a hole in the center with a diameter that allows for connection to the barrel and for the bullet to pass through without contact.

The target side end cap of the present invention is designed to allow the bullet to leave the buffer plenum and retain as much gas as possible in the plenum enclosure without contacting the bullet. The diameter of the central hole in the target side end cap should be as close to the bullet diameter as possible without allowing contact with the bullet as it passes through. This ensures as much gas pressure as possible is retained in the plenum for as long as possible. Avoiding contact with the bullet ensures maximum accuracy. The target side end cap may be attached to the rest of the plenum assembly by any method, not limited to the following: threaded, welded, bolted, snap-on, quick attach, clamp etc. The target side end cap may be fabricated from, but not limited to, steel, stainless steel, titanium, aluminum, polymer, ceramic, Inconel, etc.

The plenum tube of the present invention connects and aligns the barrel side end cap with the target side end cap. The plenum tube or cylinder wall is designed to keep the barrel side end cap concentric with the target side end cap. This ensures that the projectile holes are perfectly aligned with the barrel so that the bullet does not impact the plenum. The plenum tube also holds in position the one or more chamber walls. The plenum tube may be attached to the rest of the plenum assembly by any method, not limited to the following: threaded, welded, bolted, snap-on, quick attach, clamp etc. The plenum tube may be fabricated from, but not limited to steel, stainless steel, titanium, aluminum, polymer, ceramic, Inconel, etc.

The one or more chamber walls create multiple small chambers inside the buffer plenum. The chamber walls are designed to fit concentrically inside the plenum tube. The chamber walls each also have a center hole designed to be just slightly larger than the bullet diameter. The bullet should pass through this hole without making contact. The preferred embodiment of the present invention consists of multiple chamber walls. Creating multiple chambers allows the buffer plenum to act as a capacitor and store the gas charge to create continuous effective bolt pressure. The chamber walls may be attached to the rest of the plenum assembly by any method, not limited to the following: pressure fit, threaded, welded, bolted, snap-on, quick attach, clamp etc. The chamber walls may be fabricated from, but not limited to, steel, stainless steel, titanium, aluminum, polymer, ceramic, Inconel, etc.

A gas tube hole is configured in the barrel side end cap. This gas tube hole receives, retains, and supports the gas tube. As the bullet enters the buffer plenum, the gas pressure in the plenum escapes through the gas tube hole and into the gas tube where it passes on to the bolt mechanism and cycles the firearm. The gas tube hole may alternately be connected to a piston system for a hard linkage to the bolt. The gas tube hole may be produced by, but not limited to drilling.

The gas buffer plenum may, in an alternate embodiment, be formed from the barrel stock. A suitable barrel could be counter bored to form the plenum tube and thereby eliminate the barrel side end cap. The plenum tube is preferably connected to the barrel side end cap in one of the following ways, but not limited to: threaded on, pressure fit, clamped, bolted, welded, quick attach, snap on, etc. This interface must be precise so that the plenum tube and the barrel side end cap maintain concentricity. The barrel side end cap and the plenum tube may also be formed from the same piece of material and made monolithic.

The chamber walls should be precisely held inside the plenum tube. They must be held so that they maintain concentricity between each other, the plenum tube, and the barrel side end cap. The number of chamber walls, and the size of the chambers will vary on caliber of the firearm and the optimization of the bolt cycling mechanism. The buffer plenum may preferably be constructed of one or more chambers. The chamber walls may be secured inside the plenum tube in the following ways, but not limited to: threaded on, pressure fit, clamped, bolted, welded, quick attach, snap on, etc.

The target side end cap is preferably connected to the plenum tube in the following ways, but not limited to: threaded on, pressure fit, clamped, bolted, welded, quick attach, snap on, etc. The plenum tube and the target side end cap may alternately be formed from one piece of material. The target side end cap must also be held in concentricity with the plenum tube. The center hole of the target side end cap must be sized to allow the bullet to pass through without contact, but with extremely tight clearance to catch as much gas as possible. The gas tube hole should be aligned with the gas tube of the firearm. Typically, this is vertically aligned, but this does not have to be the case. However, the gas tube hole must be aligned with the gas tube or the piston drive system so as to provide adequate gas flow back to the bolt for proper cycling.

In summary, the present invention provides a gas buffer plenum positioned at the end of the barrel of an automatic firearm. The barrel side end cap connects the system to the barrel. The plenum tube holds the chamber walls and retains the gas pressure. The target side end cap creates the final pressure chamber enclosure and is attached to the plenum tube to lock the system together. This gas buffer plenum allows the bullet to leave the barrel of the firearm before the bolt of the firearm starts to open. As the gas buffer plenum is filled with the exploding gas behind the bullet, the gas chambers build and maintain pressure that is then forced back through a hole in the plenum. The gas is forced down a gas tube or into a piston system. Depending on the configuration of the firearm, either the gas force, or the piston strikes the bolt and cycles the firearm. The gas buffer plenum may operate in semi-automatic or fully automatic function. The system may also be used to retrofit a gas operated firearm that uses a traditional gas block design.

The components of the system of the present invention could be reconfigured by changing the number of chamber walls in the assembly, and thus the length of the plenum tube. The plenum tube may also be eliminated and the chamber walls may be fixed together in series by welding, bolting or threading so that they generate the same concentric line of chambers required for operation. The gas tube hole may be positioned in any chamber space from any direction. Repositioning of the gas tube hole to an alternate end cap or plenum tube location can change the aesthetics and the performance of the bolt cycling function. The components may also interface with a gas tube back to the bolt, or reconfigured with a piston shaft that contacts the bolt. The barrel of the firearm may itself be machined to eliminate the need for a barrel side end cap, with the plenum tube being formed as part of the barrel. The barrel could also have a gas tube gun drilled into it to transmit the gas back from the plenum tube.

The gas buffer plenum is preferably either installed on a new gas operated firearm or retrofitted to an existing gas operated firearm. The user aims this firearm at a target, removes the firearm safety, and pulls the trigger to fire. As the round fires, the exploding gas pressure forces the bullet down the barrel. As it exists the rifling, it enters into the gas buffer plenum. The gas pressure behind the bullet is transmitted into the chambers and forced back through the gas tube hole. The gas travels from the gas tube hole into the gas tube and back to the bolt in the receiver. The gas pressure forces the bolt open, but not until after the bullet has left contact with the barrel rifling. The bullet leaves the gas buffer plenum and precisely impacts the target. The user then depresses the trigger again to fire another shot, or may put the firearm back on safety and cease fire. In fully-automatic mode, the user could hold down the trigger and the firearm would continue to load and fire rounds automatically.

The end of barrel gas plenum of the present invention can not only be used as the gas operation system for a new firearm, it may also be used as a retrofit kit for existing firearms. The port hole of the barrel of an existing firearm can be plugged and the gas block removed. Alternately, the gas block may be turned so that it blocks the port hole in the barrel. Thereafter, the plenum of the present invention may be added to the end of the barrel. A longer gas tube may be connected between the receiver and the end of barrel gas plenum. Alternately, a piston system may be installed as the gas force transmission system.

The end of barrel gas buffer plenum may also be modified with additional baffles and materials to form an integrated suppressor. This would dramatically reduce the sound of the shot, and still function to cycle the firearm.

Any gas operated firearm could benefit from the present invention. The end of barrel gas buffer plenum may be designed onto the end of the barrel of any new firearm, and connected to the receiver with the standard gas tube or piston. Alternately, the plenum may be retrofitted to any existing gas operated firearm. The system would benefit by increased accuracy, cleaner operation and more robust cycling of the firearm.

BRIEF DESCRIPTION OF THE DRAWINGS

FIG. 11A showing the valve in a condition for directing gas up through the prior art barrel port back to the bolt action, and FIG. 11B showing the valve in a condition for directing gas from the end of the barrel plenum of the present invention back to the bolt action.

DETAILED DESCRIPTION OF THE PREFERRED EMBODIMENTS

Figure 1:
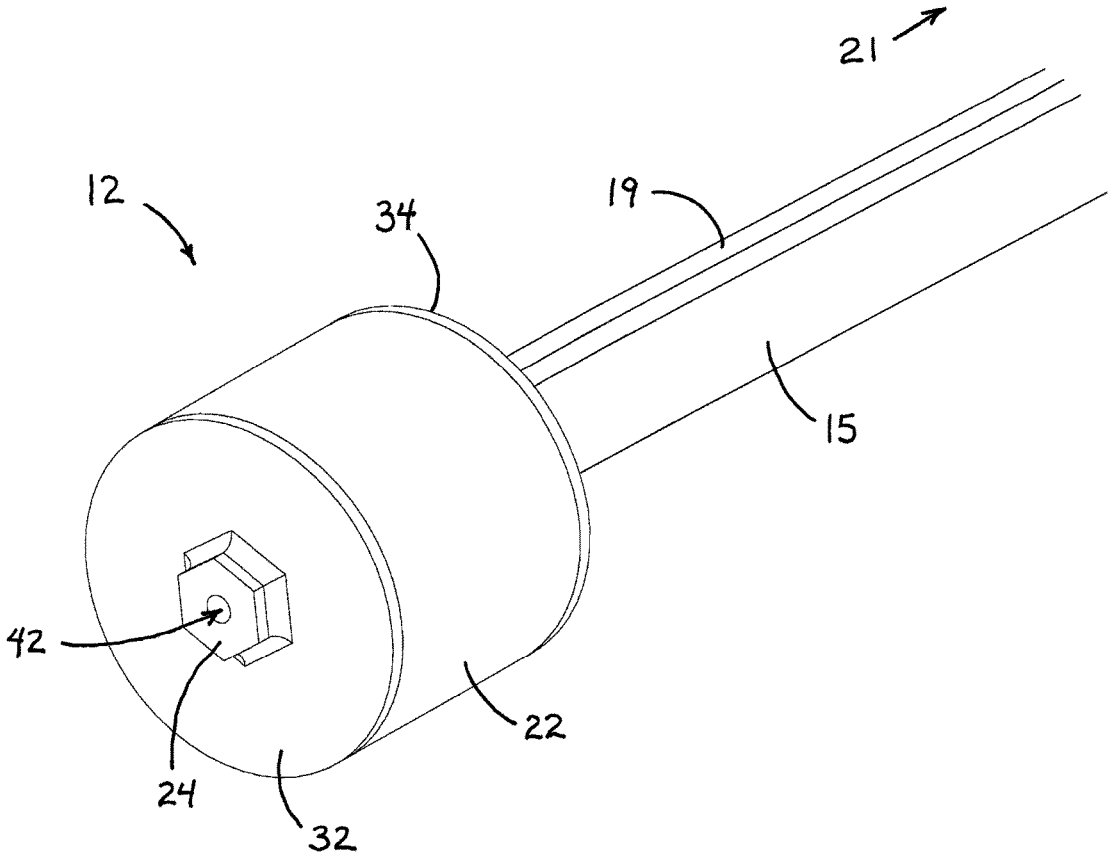
FIG. 1 is a perspective view of a first preferred implementation of the system of the present invention on a typical firearm barrel removed from the associated firearm for clarity.

Reference is made first to FIG. 1 which is a perspective view of a first preferred embodiment of the system of the present invention implemented on the end of a typical firearm barrel, removed from the associated firearm for clarity. Gas cycling system 10 in the first preferred embodiment includes end of barrel gas buffer plenum 12 positioned on the end of firearm barrel 15 and connected to the weapon receiver by way of gas tube 19. Gas buffer plenum 12 is shown to generally comprise plenum tube 22 with target side end cap 32. Centered in end cap 32 is hexagonal shaped exit port 24 suitable for facilitating the rotation of gas buffer plenum 12 onto the threaded end of a typical firearm barrel. Gas tube 19 shown in FIG. 1 extends from a return port (not seen in this view) positioned on the barrel side of gas buffer plenum 12 and directs the collected pressurized gas from the gas buffer plenum 12 to conduct it back to the receiver of the weapon, whereby the high pressure gas may serve to automatically activate the bolt of the firearm.

Figure 2A:
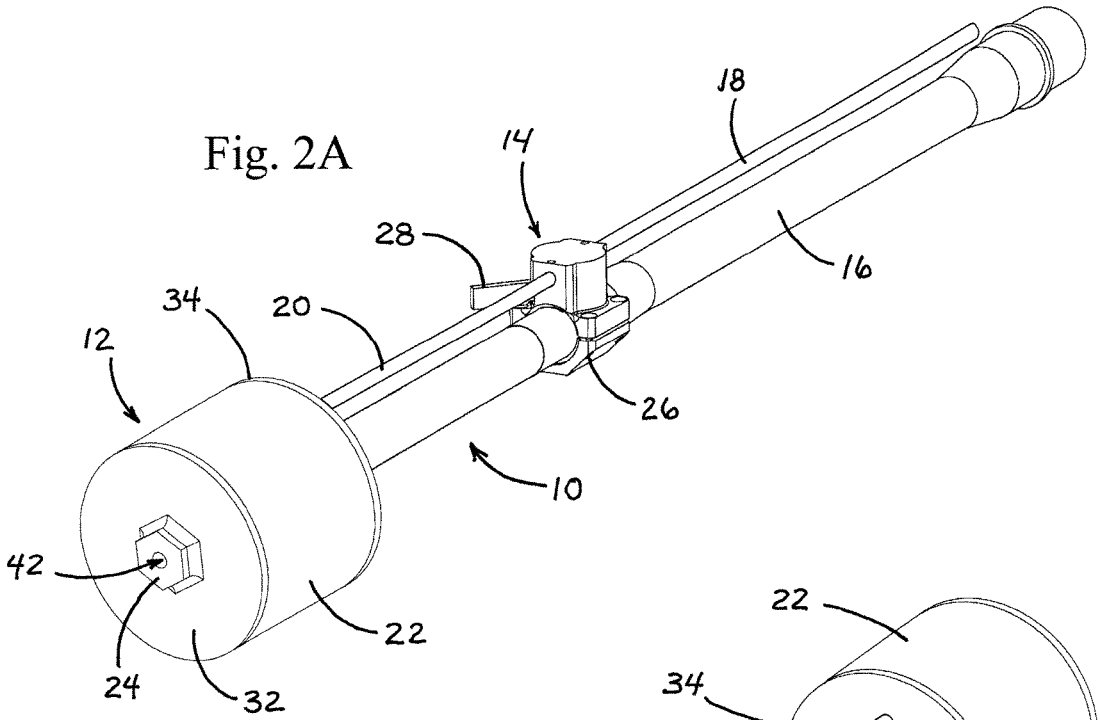
FIGS. 2A & 2B are perspective views of a second preferred implementation of the system of the present invention operable in association with a gas block valve positioned on the barrel.
Figure 2B:
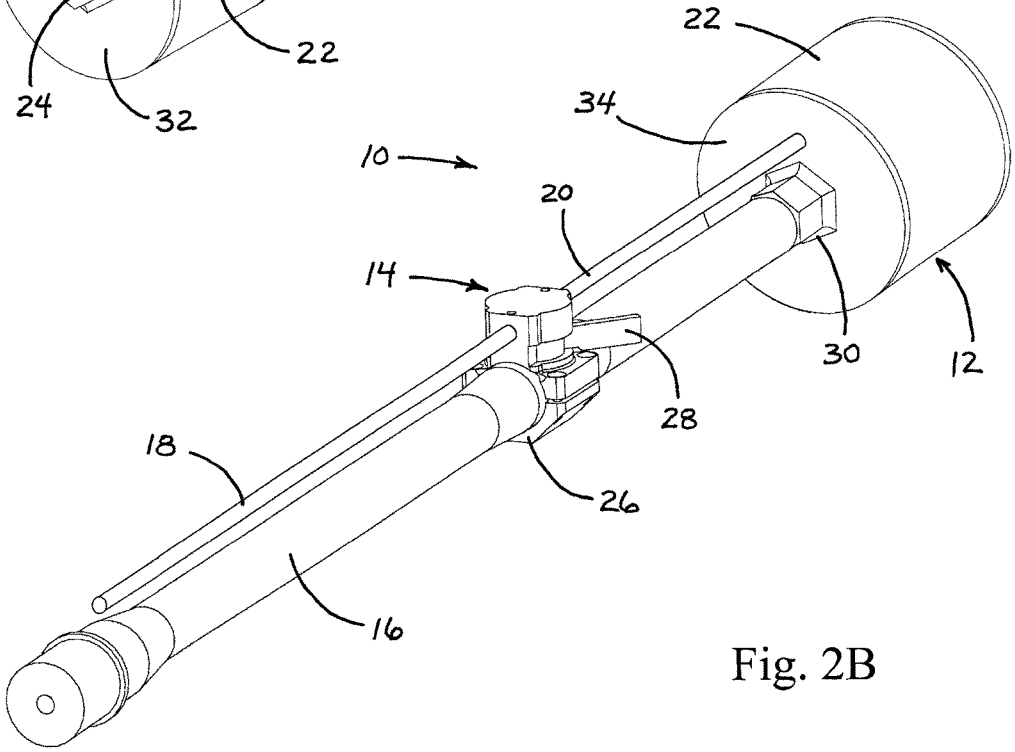

Reference is next made to FIGS. 2A and 2B which are perspective views of a second preferred embodiment of the system of the present invention implemented on a typical firearm barrel having an existing barrel gas port. Gas buffer plenum 12 is the same in this second embodiment and forms the primary component of the system of the present invention. In addition to gas buffer plenum 12, however, gas block valve 14 is positioned over an existing or drilled gas port in barrel 16. Gas tube 18 carries high pressure gas back from gas port valve 14 to the receiver of the weapon. Gas tube 20 connects the gas buffer plenum 12 with the gas port valve 14. Operation of gas port valve 14 by way of its attachment to barrel 16, using base half component 26, is achieved by movement of valve lever 28 in a manner described in more detail below. FIG. 2A shows a target side perspective view of the system with target side end cap 32 and exit port 24. FIG. 2B provides a barrel side perspective view of the second preferred embodiment of the system of the present invention showing all of the same components as FIG. 2A but additionally showing barrel side end cap 34 and hexagonal shaped barrel attachment fitting 30.

Figure 3:
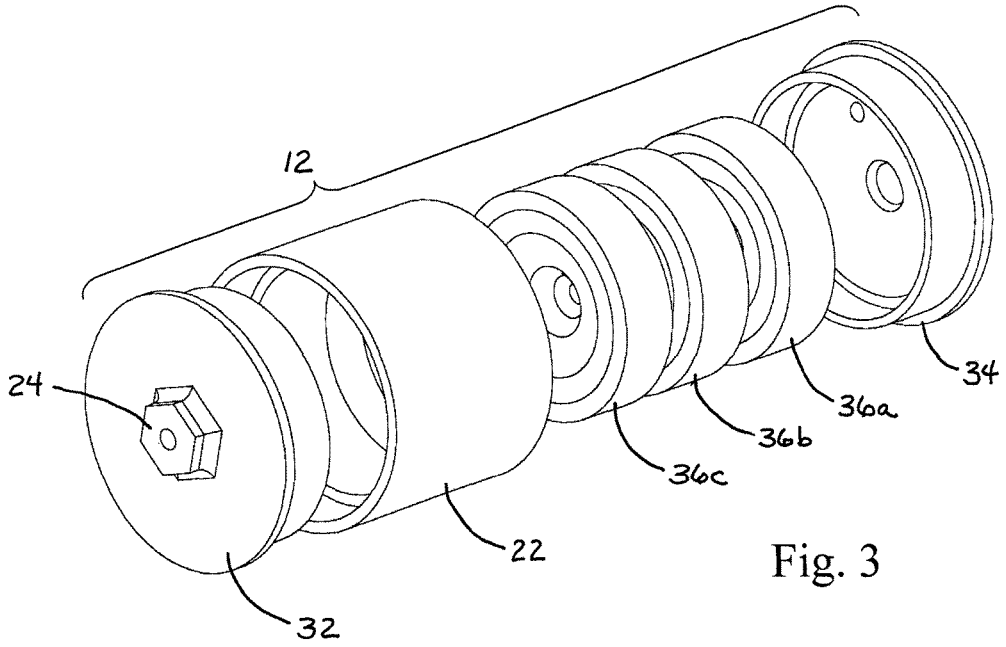
FIG. 3 is an exploded perspective view of the end of barrel gas buffer plenum of the present invention.

FIG. 3 is an exploded perspective view of the end of barrel gas buffer plenum 12 of the present invention. In this view, gas buffer plenum 12 is shown to be assembled along a single axis of each of the generally cylindrical or disc shaped components of the plenum. The view in FIG. 3 is from the target side of the plenum and includes target side end cap 32 with exit port 24. Providing the enclosing wall for the plenum is plenum tube 22 which is a simple cylindrical wall with appropriately positioned end fittings to receive target side end cap 32 and barrel side end cap 34.

Positioned within plenum tube 22, between target side end cap 32 and barrel side end cap 34, are one or more chamber walls 36*a*-36*c*. Depending upon the particular firearm to which the gas plenum is to be attached, the number of chamber walls 36 may vary from one to three or more. The greater number of chamber walls increases the collected high pressure gas that is returned to effect the bolt action on the weapon that is desired. The preferred embodiment of the present invention shown in FIG. 3 includes three such chamber walls, 36*a*, 36*b*, and 36*c*.

Figure 4:
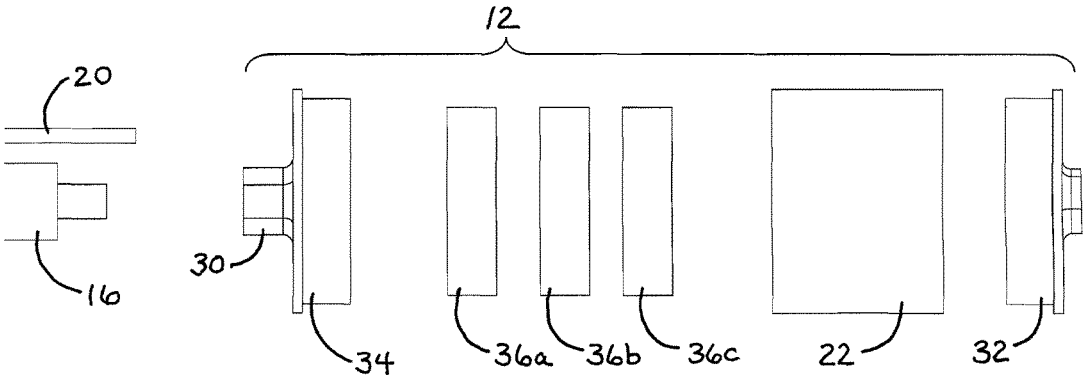
FIG. 4 is an exploded side view of the end of barrel gas buffer plenum of the present invention as shown in FIG. 3 and positioned adjacent the end of the barrel of the firearm.

FIG. 4 is an exploded side view of the end of barrel gas buffer plenum of the present invention shown in FIG. 3 and positioned as it would be adjacent the end of the barrel of the firearm. In the view of FIG. 4, barrel 16 is shown positioned parallel to gas tube 20 where they would be connected to barrel side end cap 34 by way of barrel attachment fitting 30. One or more chamber wall components 36*a*-36*c* are shown positioned between barrel side end cap 34 and target side end cap 32. Surrounding the three chamber walls 36*a*-36*c*, and sized with fittings appropriate for receiving end caps 32 and 34, is plenum tube 22. The manner in which each of these components is assembled to form the closed gas buffer plenum is described in more detail above.

Figure 5A:
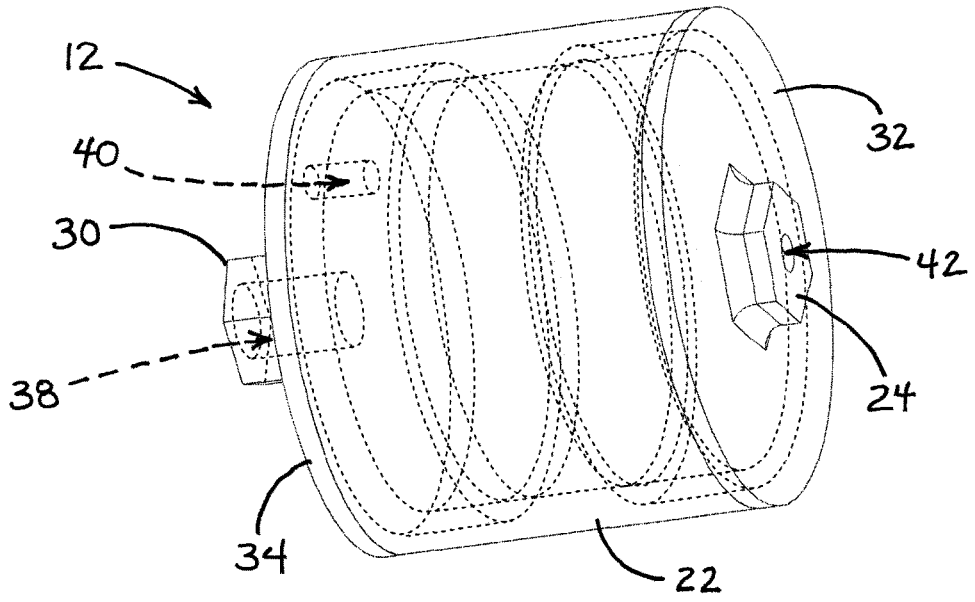
FIG. 5A is an assembled perspective view of the end of barrel gas buffer plenum of the present invention showing the internal positioning of the various components of the plenum.
Figure 5B:
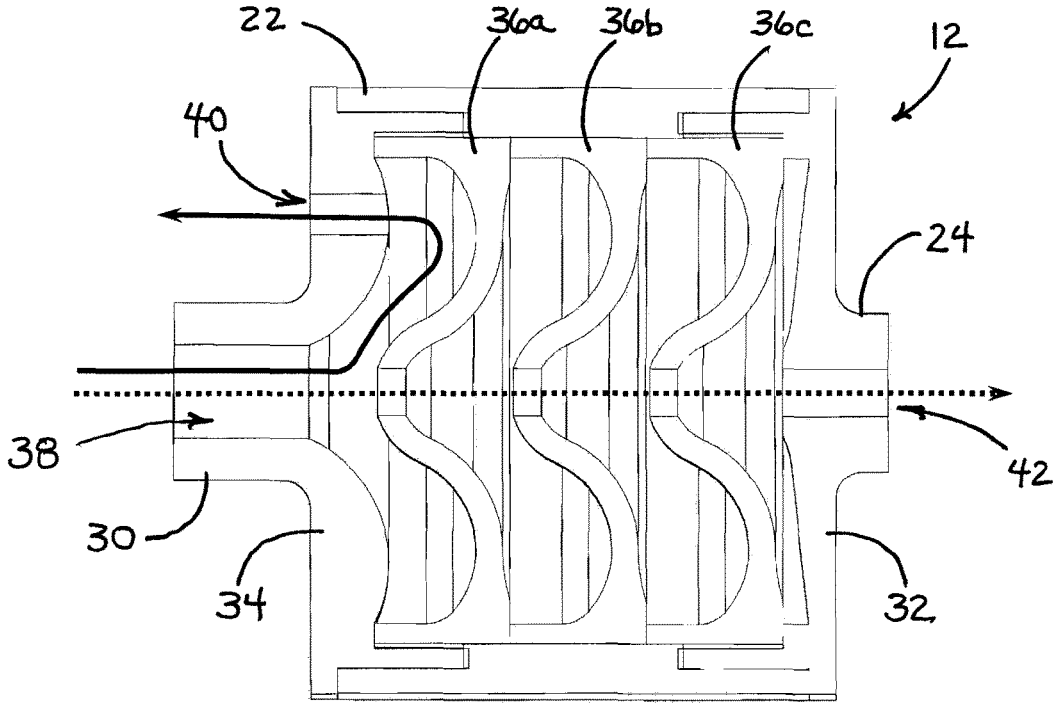
FIG. 5B is a cross-sectional side view of the end of barrel gas buffer plenum of the present invention showing the internal structures of the various components of the plenum.

FIGS. 5A & 5B, as well as 6A & 6B, show the fully assemble gas buffer plenum of the present invention. FIG. 5A is a perspective view of gas buffer plenum 12 shown fully assembled with each of the internal components visible as they would be positioned and oriented for operation of the gas buffer plenum. FIG. 5A is an assembled perspective view of the barrel gas buffer plenum 12 of the present invention showing the internal positioning of the various components of the plenum. In this view plenum 22 is shown to surround the various chamber walls as described above, and to be closed off on the target side with target side end cap 32 positioning exit port 24 with projectile aperture 42. On the opposite side of gas buffer plenum 12 is barrel side end cap 34 with barrel attachment fixture 30 providing inlet opening 38, typically internally threaded to receive the external threading of the barrel to which the gas buffer plenum is attached. Gas return port 40 is also shown in dashed outline form in FIG. 5A whereby collected high pressure gas is ducted back to the firearm by way of the connecting gas tube (not shown).

FIG. 5B is a cross-sectional view taken through the center line of gas buffer plenum 12 of the present invention. In this view, each of the components is shown in cross-section starting with the target side end cap 32 which fits securely into plenum tube 22 and closes off the internal volume taken up generally by chamber walls 36*a*-36*c*. The opposite end of plenum tube 22 is closed off with barrel side end cap 34 which likewise fits tightly into plenum tube 22 to fully enclose the gas buffer plenum with the exception of the projectile path (dotted line arrow) and the return gas path (solid line arrow).

Because the gas behind the projectile is rapidly expanding, the passage of the projectile from the end of the firearm barrel allows the expanding gas to be directed outward from behind the projectile rather than simply pushing the projectile forward, as it does within the barrel. This outward expansion of the gas is captured and directed by each of the chamber walls 36*a*-36*c*. The greater the number of chamber walls, the more of the high pressure expanding gas is collected and eventually ducted back to the weapon receiver through gas return port 40 by way of the gas tube (not shown). Each of the components of the gas buffer plenum 12 shown in FIGS. 5A & 5B, may be assembled through a variety of secure fittings and seam closures as described above. Again, other than the intended projectile ports and gas return port, all seams for gas buffer plenum 12 should be closed so as to fully contain and appropriately direct the high pressure gas that the plenum experiences. Again, various methods of assembling and securing the components together with tight seams are anticipated. Those skilled in the art will recognize that the basic structures of the gas buffer plenum shown in FIG. 5B (for example) may be constructed from separate components, or may be machined from a single solid material component, or as few as two attached milled and machined components. The various components described in the preferred embodiment herein need not be configured separately, but do describe as separate components, the various essential features of the fully assembled or fully constructed gas buffer plenum 12.

Figure 6A:
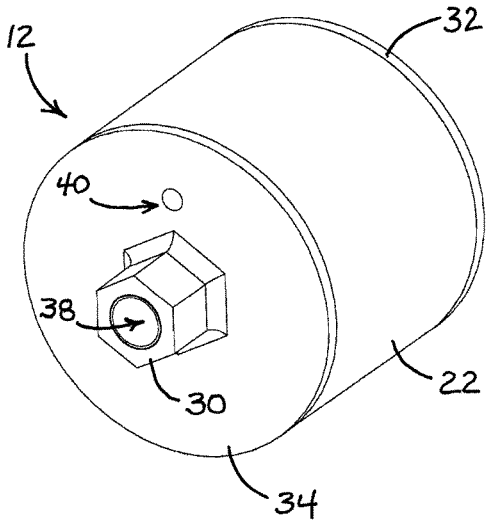
FIGS. 6A & 6B are perspective views of the end of barrel gas buffer plenum of the present invention showing the barrel side (FIG. 6A) and the target side (FIG. 6B).
Figure 6B:
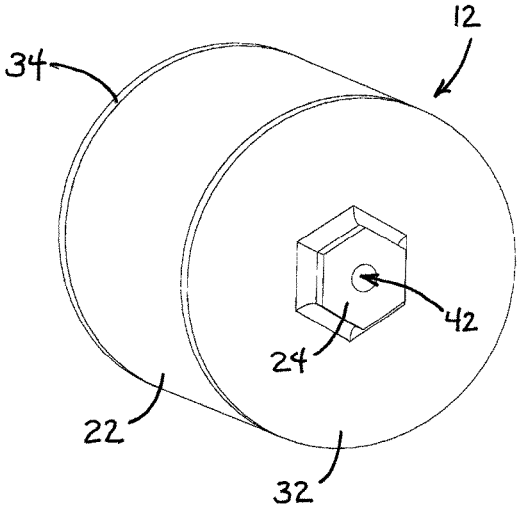

FIGS. 6A & 6B are perspective views of the end of barrel gas buffer plenum 12 of the present invention showing the barrel side (FIG. 6A) and the target side (FIG. 6B). On the barrel side shown in FIG. 6A, plenum tube 22 is shown to be closed off with target side end cap 32 and barrel side end cap 34. Positioned on barrel side end cap 34 is barrel attachment fitting 30 with barrel connection port 38. Also shown on barrel side end cap 34 is gas return port 40. FIG. 6B shows the target side of gas buffer plenum 12, providing plenum tube 22 closed off with target side end cap 34 and barrel side end cap 32. Positioned on barrel side end cap 32 is hexagonal exit port fitting 24 with projectile aperture 42 shown centered in the construction.

Figure 7A:
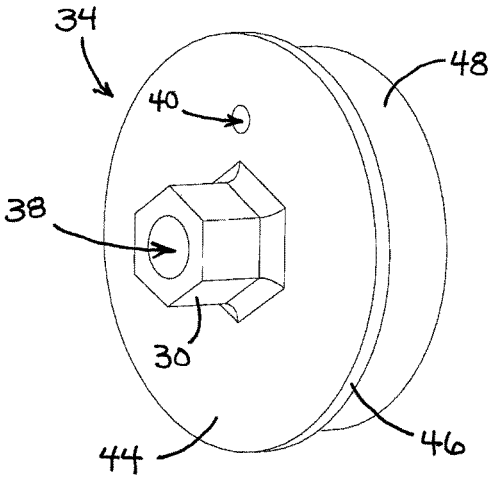
FIGS. 7A & 7B are perspective views of the barrel side end cap of the end of barrel gas buffer plenum of the present invention showing the external face (FIG. 7A) and the internal face (FIG. 7B).
Figure 7B:
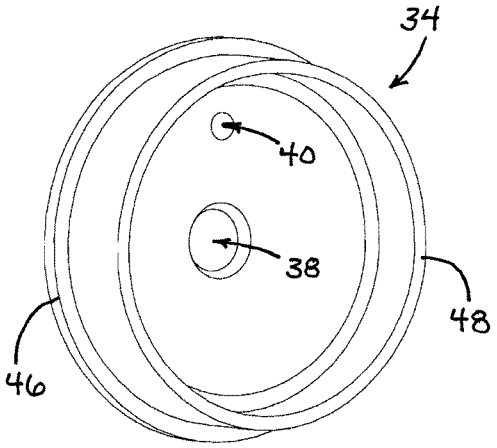

FIGS. 7A & 7B are perspective views of the barrel side end cap of the end of barrel gas buffer plenum 12 of the present invention, showing the external face (FIG. 7A) and the internal face (FIG. 7B) of the component. The barrel side end cap, in the preferred embodiment, is constructed from a generally cylindrical wall 48 sized to fit within a machined recess in plenum tube 22 as described above. Cylindrical wall 48 is closed by way of circular wall 46 which establishes barrel side face 44. Centrally positioned within barrel side face 44 is barrel attachment fitting 30 with barrel attachment port 38. Also positioned within barrel side face 44 is gas return port 40 to which gas tube (not shown) is attached. FIG. 7B shows the internal features of barrel side end cap 34 with cylindrical wall 48 closed by wall 46 with the central port 38 and gas return port 40 shown positioned therein.

Figure 8A:
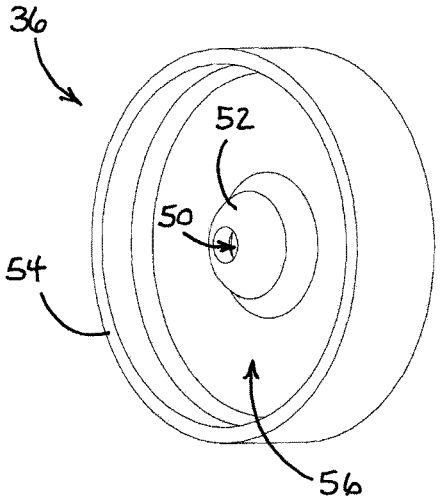
FIGS. 8A & 8B are perspective views of a typical (one of three in the preferred embodiment) chamber wall of the end of barrel gas buffer plenum of the present invention showing the barrel side face (FIG. 8A) and the target side face (FIG. 8B).
Figure 8B:
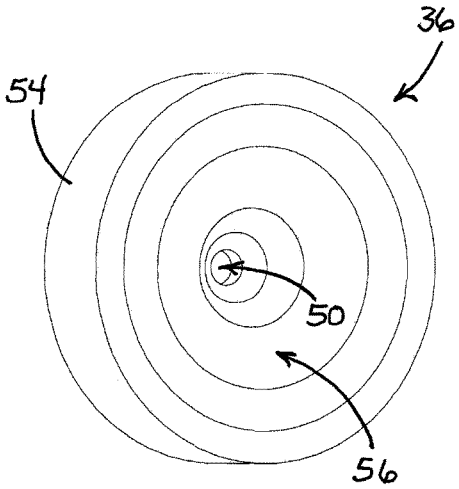

FIGS. 8A & 8B are perspective views of a typical (one of three in the preferred embodiment) chamber wall of the end of gas barrel buffer plenum of the present invention showing the barrel side face (FIG. 8A) and the target side face (FIG. 8B). The construction of chamber wall 36 includes cylindrical wall 54 with internal circular wall 56. Centrally positioned on circular wall 56 is gas extraction dome 52 which is a portion of the interior chamber wall that extends towards the barrel and generally serves to spread the expanding gas out to all sides after the passage of the projectile through projectile port 50. In this manner, the expanding gas directed to the side, may return by way of the gas return port (not shown), having been collected by the one or more chamber walls as the projectile passes through the gas buffer plenum and the expanding gas is directed outward by the shaped configuration of each of the chamber walls.

Figure 9A:
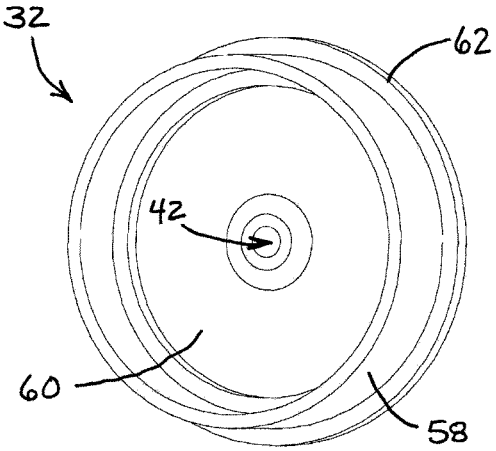
FIGS. 9A & 9B are perspective views of the target side end cap of the end of barrel gas buffer plenum of the present invention showing the internal face (FIG. 9A) and the external face (FIG. 9B).
Figure 9B:
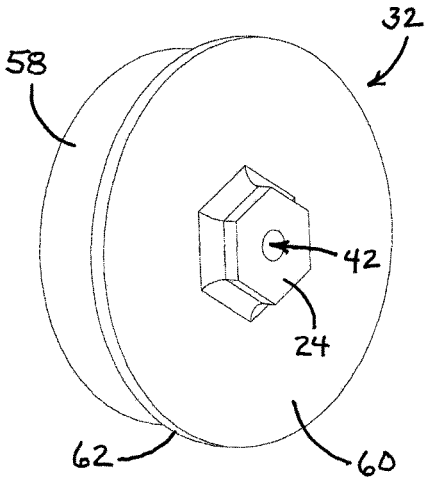

FIGS. 9A & 9B are perspective views of the target side end cap of the end of barrel gas buffer plenum of the present invention showing the internal face (FIG. 9A) and the external face (FIG. 9B). Like barrel side end cap 34, target side end cap 32 is constructed of cylindrical wall 58 closed off with circular wall 60 through which projectile port 42 is centrally configured. Circular edge 62 provides the seat against which plenum tube 22 fits in order to fully close off the gas buffer plenum. FIG. 9A shows the target side view of the target side end cap, again disclosing cylindrical wall 58 which fits within plenum tube 22 as well as edge 62 which meets the mating edge of plenum tube 22. Target side face 60 is shown to centrally contain exit port 24 with projectile exit aperture 42 centrally positioned therein.

Reference is next made to FIGS. 10A-10F for a detailed description of an optional barrel mounted gas block valve to complete certain embodiments of the system of the present invention. Whereas the end of barrel gas buffer plenum 12 that is the primary focus of the present invention may be utilized in conjunction with firearms that do not have existing barrel gas port return structures, it is also possible to retrofit an existing automatic firearm that does incorporate a barrel gas port so that it may utilize the buffer plenum of the present invention in a replacement or an alternate manner. The gas block valve 14 shown initially in FIGS. 2A & 2B, may be positioned on the barrel of the firearm in place of whatever existing return gas port connection may already be in place. The structure of gas block valve 14 when it is used in an alternate preferred embodiment of the present invention is as shown in FIGS. 10A-10F.

Figure 10A:
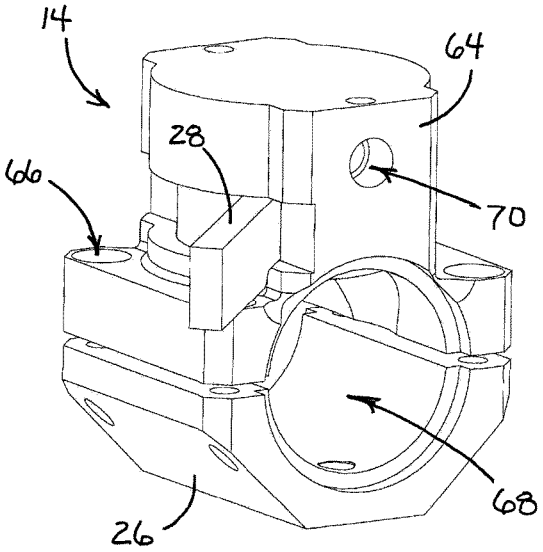
FIG. 10A is a detailed perspective view of the barrel mounted gas block valve of the system of the present invention.
Figure 10B:
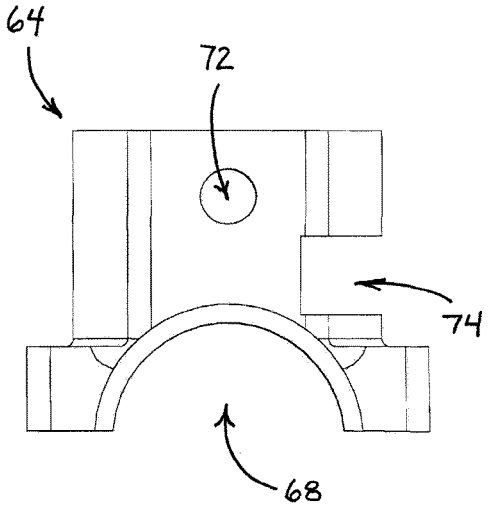
FIG. 10B is a detailed side view of the top component of the barrel mounted gas block valve of the system of the present invention.

FIG. 10A is a detailed perspective view of the barrel mounted gas block valve of the second preferred embodiment of the system of the present invention. In this view, gas block valve 14 is configured as it would appear mounted to the barrel of the firearm. The barrel itself is removed in this view for clarity, but would be positioned through barrel port 68 configured by the connection of the two halves of gas block valve 14. A top half 64 is positioned on the top of the barrel, while a bottom half 26 is aligned and connected to the top half through a number of attachment bolts, screws, or the like. The four attachment bolts or screws may be positioned in apertures 66 on the top half 64 of the valve, and may be received into threaded apertures 94 which are positioned in an aligned manner on the bottom half 26 of the gas block valve.

The object of gas block valve 14 is to allow the user to direct the expanding gases within the barrel back to the firearm receiver, either in the conventional manner by ducting them away from a position on the barrel where a gas port has been drilled, or closing the gas port on the barrel and conducting the expanding gas back from the end of barrel gas buffer plenum of the present invention. In FIG. 10A, forward port 70 in the top half 64 of gas block valve 14 receives the expanding gas from the end of barrel gas buffer plenum of the present invention. Valve lever 28 allows the user to switch between the gas port drilled in the barrel and the gas port 70 receiving the expanding gas from the end of barrel gas buffer plenum. Valve lever 28 moves within slot 74 positioned on the side of top half 64 of gas block valve 14. Gas port 72 directs the expanding gas from either of the two selected sources back to the receiver of the firearm.

Figure 10C:
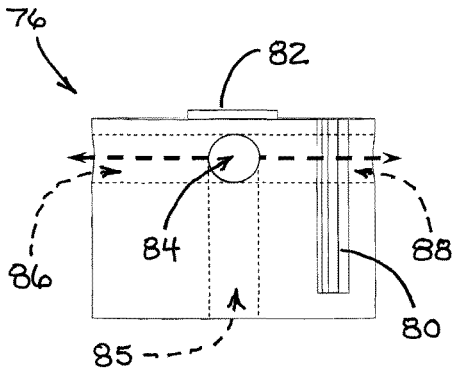
FIGS. 10C & 10D are detailed side views of the rotating valve core of the barrel mounted gas block valve of the system of the present invention; the view in FIG. 10D rotated 90° from the view in FIG. 10C.
Figure 10D:
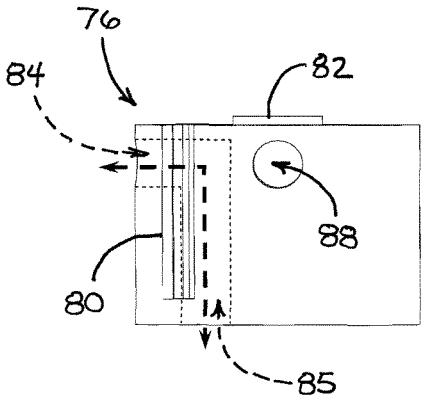

FIGS. 10C & 10D show in detail the structure of the internal core of gas block valve 14, comprising a rotating cylinder with appropriately constructed conduits to alternately direct expanding gas straight through the valve from the gas buffer plenum, or up from the gas port in the barrel and out the back of the gas block valve. Rotating valve core 76 pivots on axis 82 and is moved by the use of valve lever 28, which is positioned within captive slot 80 on the side of the rotating core. Port 88 connects straight through the core to port 86 and connects the gas input from the gas buffer plenum to the gas output on the valve when the gas port in the barrel is cut off. Rotating the valve core 76 positions gas port 85 in the core with the gas port drilled in the barrel (see FIG. 11A) and conducts the expanding gas therefrom out through gas port 84 in valve core 76 at a right angle to the gas port drilled in the barrel. Dashed line arrows in FIGS. 10C & 10D represent the two alternate flows of expanding gas through valve core 76.

Figure 10E:
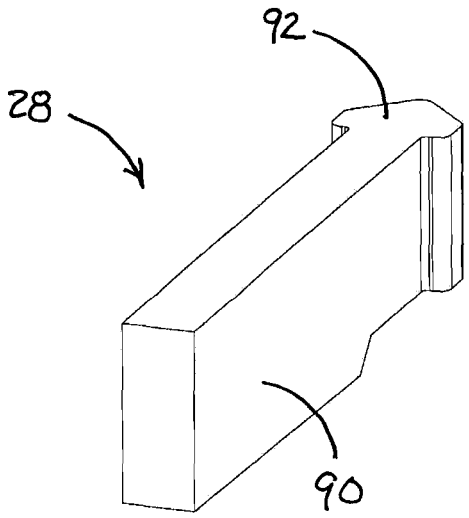
FIG. 10E is a detailed perspective view of the valve lever of the barrel mounted gas block valve of the system of the present invention.
Figure 10F:
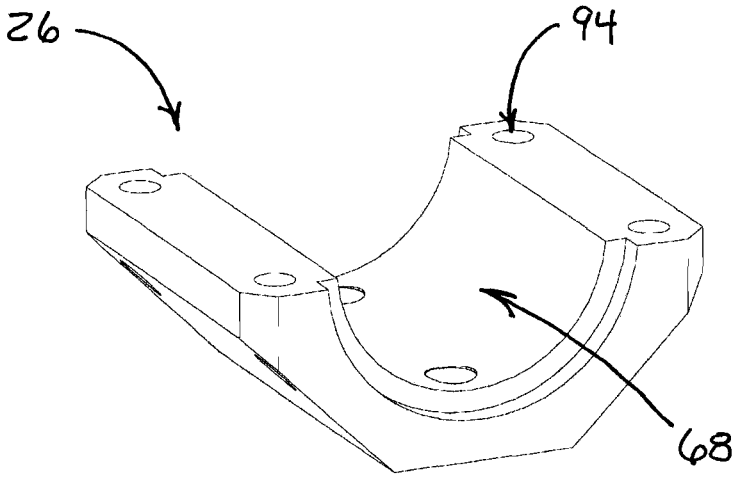
FIG. 10F is a detailed perspective view of the bottom component of the barrel mounted gas block valve of the system of the present invention.

FIG. 10E is a detailed perspective view of valve lever 28 comprising captive slot tab 92 structured to engage and be held captive by slot 80 in the rotating core, as well as lever handle 90. FIG. 10F is a detailed perspective view of the bottom half 26 of gas block valve 14 which attaches to top half 64 in the manner described above.

Figure 11A:
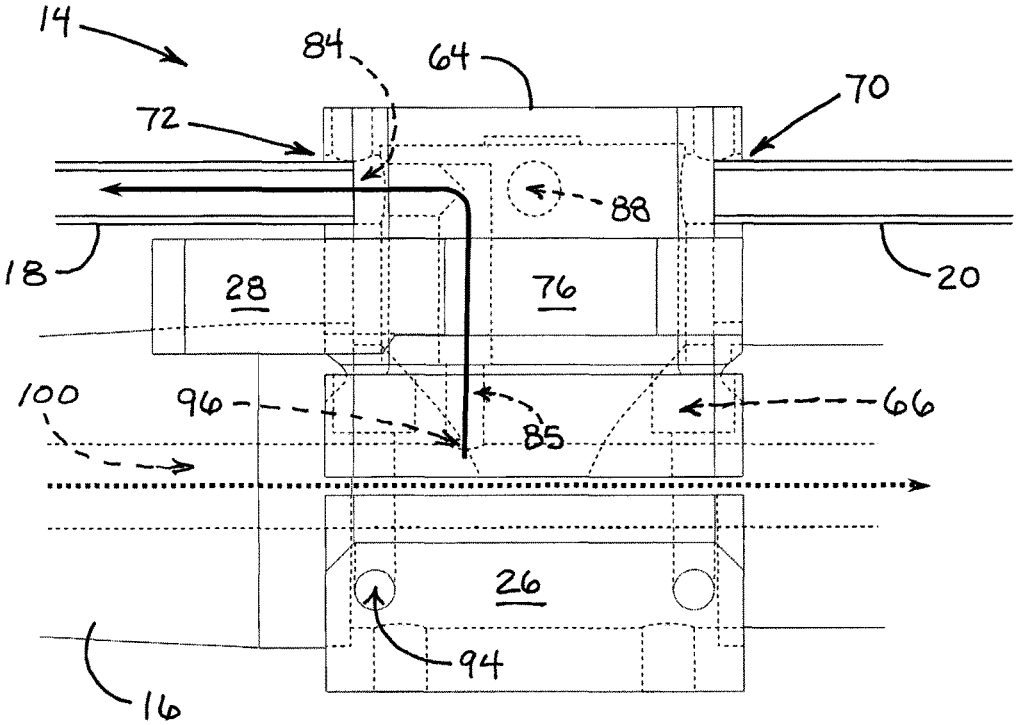
FIGS. 11A & 11B are detailed side elevational views of the barrel mounted gas block valve of the system of the present invention.
Figure 11B:
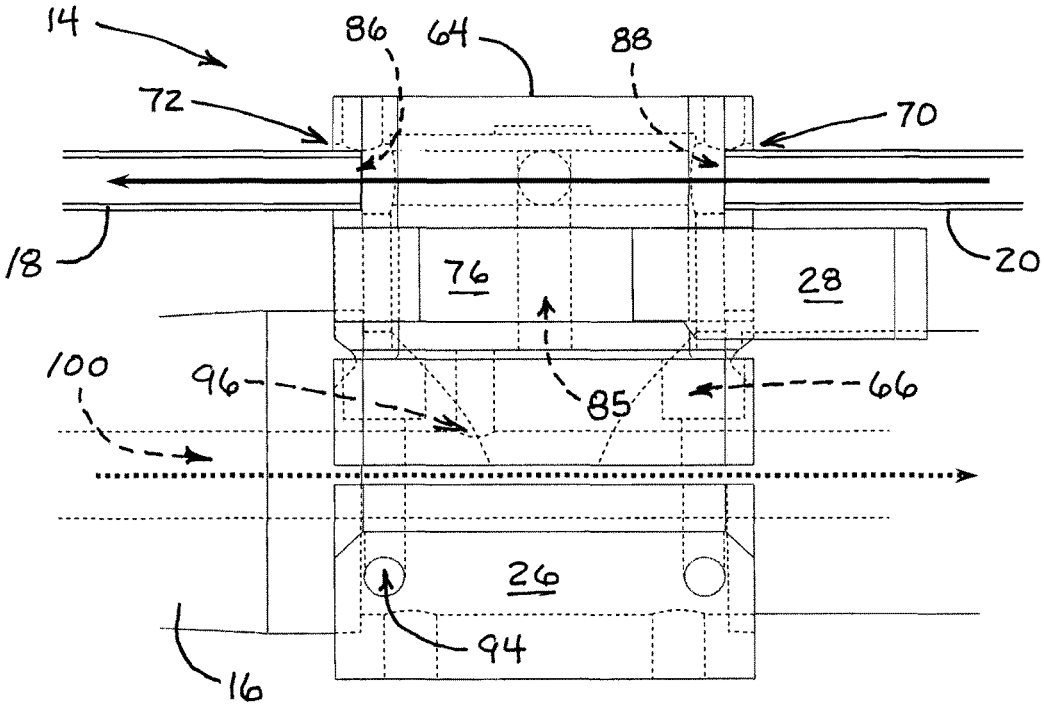

FIGS. 11A & 11B show in greater detail the manner in which the various gas flow conduits are alternately established depending upon the rotation of valve lever 28 and its corresponding rotation of valve core 76. FIG. 11A shows a manner of utilizing the gas port drilled or pre-drilled into the barrel of the firearm comprising barrel gas port 96. Port 96 represents a drilled passage from the external surface of the barrel to the rifled bore 100 of the barrel 16. In the view of FIG. 11A, port 70 connects by way of gas tube 20 forward to the gas buffer plenum of the present invention. Port 72 connects the gas block valve 14 by way of gas tube 18 to the receiver mechanism for the firearm.

FIG. 11B shows the result of rotating valve core 76 by pushing valve lever 28 forward, thereby cutting off barrel port 96 and opening the straight through conduit of valve core 76, comprising connecting port 88 with port 70 and port 86 with port 72. This straight through configuration shown in FIG. 11B represents the preferred use of the system of the present invention, cutting off any pre-existing barrel gas ports and utilizing the end of the barrel gas buffer plenum. In FIGS. 11A & 11B, gas flow is shown with solid line arrows, and the path of the projectile through the barrel is shown with dotted line arrows.

While the present invention has been described in conjunction with a number of preferred embodiments, those skilled in the art will recognize that certain modifications to the described embodiments still fall within the spirit and scope of the invention. In particular, the number of chamber walls used to construct the gas buffer plenum of the present invention will vary depending upon the caliber of the projectile and its gunpowder load. In general, the more chamber walls that are positioned within the gas buffer plenum, the greater quantity of high pressure gas is directed backward to the receiver of the firearm to activate the bolt mechanism. Different bolt mechanisms require varying levels of force to properly activate and any required force can be generated by selecting the size and number of the chamber walls within the gas buffer plenum. In addition, although a gas block valve has been described in connection with the present invention, it is also possible to simply close off an existing gas port in the barrel of a firearm and utilize instead only the gas buffer plenum of the present invention. Various mechanisms for closing off pre-drilled gas ports in barrels are anticipated.

The overall geometry of the gas buffer plenum described herein may also vary depending upon the particular firearm to which the device is attached. Those skilled in the art will recognize that there are limitations on the overall diameter of the preferred embodiment for the gas buffer plenum that are dictated by the ability to maintain target sighting across the plenum when attached to the end of the barrel. Otherwise, the diameter of the gas buffer plenum is variable and may be adjusted both according to the number of chamber walls to be positioned within the plenum and the overall force required to activate the bolt of the automatic weapon.

These variations in geometry, while still utilizing the basic structures of the present invention, do not necessarily depart from the scope of the invention as defined by the claims which follow.

We claim:

1. A gas buffer plenum positioned at the end of a firearm barrel to collect, store and direct high pressure gas through a gas tube back to a receiver of the firearm to cycle a bolt of the firearm after the bullet has exited the barrel, the gas buffer plenum comprising:

(a) a plenum enclosure having a barrel oriented end and a target oriented end;

(b) a barrel-side wall on the barrel oriented end of the plenum enclosure, the barrel-side wall comprising:

(i) a center axis barrel collar attachable to the end of the barrel of the firearm;

(ii) a center axis bullet inlet port; and (iii) an offset return gas port;

(c) a target-side wall on the target oriented end of the plenum enclosure, the target-side wall comprising a center axis bullet exit port; and (d) at least one chamber wall positioned within the plenum enclosure between the barrel-side wall and the target-side wall, the at least one chamber wall comprising a center axis bullet pass-through port and a concentric buffer wall generally perpendicular to a bullet direction of travel, the concentric buffer collecting, storing, and redirecting expanding gas from behind a passing bullet back from the plenum enclosure to the offset return gas port of the barrel-side wall;

wherein the expanding gas is directed through the return gas port into the gas tube and is conducted to the receiver of the firearm to cycle the bolt, and wherein the firearm barrel further includes a barrel gas port and the gas tube extending from the return gas port to the receiver of the firearm is interrupted with a cut-off valve positioned at the barrel gas port, the cut-off valve alternately connecting the barrel gas port or the offset return gas port to the receiver of the firearm.

2. The gas buffer plenum of claim 1 wherein the cut-off valve comprises:

a clam-shell valve enclosure clamped around the firearm barrel at the position of the barrel gas port, the valve enclosure comprising a forward port for receiving the gas tube back from the offset return gas port of the gas buffer plenum and a rearward port for directing a gas tube back to the receiver of the firearm;

a rotating valve core positioned within the valve enclosure, the rotating valve core defining a first passage for connecting the barrel gas port to the rearward port and a second passage for connecting the forward port to the rearward port, the valve core rotating to alternately align either the first or second passage; and a valve core handle for rotating the valve core.

3. A suppressor positioned at the end of an automatic firearm barrel to collect, store and direct high pressure gas through a gas tube back to a receiver of the automatic firearm to cycle a bolt of the automatic firearm after the bullet has exited the barrel, the bullet having a direction of travel as it exits the barrel, the suppressor comprising:

(a) a suppressor enclosure having a barrel oriented end and a target oriented end and comprising a return gas port on the barrel oriented end, the gas tube connected to the return gas port; and (b) at least one chamber wall positioned within the suppressor enclosure, the at least one chamber wall oriented generally perpendicular to the bullet direction of travel and comprising a bullet pass-through port and a surrounding buffer wall collecting, storing, and redirecting expanding gas from behind a passing bullet back from the suppressor enclosure through the return gas port;

wherein the expanding gas directed through the return gas port into the gas tube is conducted to the receiver of the automatic firearm to cycle the bolt, and wherein the firearm barrel has a barrel gas port assembly and the return gas port of the suppressor enclosure is connected to the gas tube back to the receiver of the firearm through the barrel gas port assembly, wherein the barrel gas port assembly further comprises a cut-off valve to alternately direct a flow of gas back to the receiver of the firearm alternately from either the barrel directly or the suppressor enclosure.

4. The suppressor of claim 3 wherein the at least one chamber wall comprises at least three chamber walls arranged in sequential stacked alignment within the suppressor enclosure.

5. The suppressor of claim 4 wherein each of the at least three chamber walls comprises a circular disk-shaped insert comprising a central convex portion oriented towards the barrel and a concentric concave ring portion around the central convex portion, whereby expanding gas from behind a passing bullet is initially directed outward and over the central convex portion and is then directed outward and back within the concave ring portion.

* * * * *